US005941658A

United States Patent [19]

Dahlinger et al.

[11] Patent Number: 5,941,658

[45] Date of Patent: Aug. 24, 1999

[54] CROSS-SLOPE LEVEL CONTROL FOR MOBILE MACHINERY

[75] Inventors: Gerald Lee Dahlinger, Manteca; Scott Michael Mallory, Riverbank, both of Calif.

[73] Assignee: Guntert & Zimmerman Constr. Div. Inc., Ripon, Calif.

[21] Appl. No.: 08/867,027

[22] Filed: Jun. 2, 1997

[51] Int. Cl.[6] ..... E01C 23/07; E01C 19/48

[52] U.S. Cl. ..... 404/84.1; 404/84.8; 37/907; 172/4.5

[58] Field of Search ..... 404/84.05, 84.1, 404/84.2, 84.5, 84.8, 98; 37/907; 172/4.5; 701/50

[56] References Cited

U.S. PATENT DOCUMENTS

| | | |
|---|---|---|
| 3,423,859 | 1/1969 | Swisher, Jr. et al. . |
| 3,637,026 | 1/1972 | Snow . |
| 3,749,504 | 7/1973 | Smith . |
| 4,029,165 | 6/1977 | Miller et al. . |
| 4,403,889 | 9/1983 | Gillotti . |

*Primary Examiner*—James A. Lisehora
*Attorney, Agent, or Firm*—Townsend and Townsend and Crew

[57] ABSTRACT

A cross slope level/torsion control for mobile machines is disclosed. At least two crawler tracks or four wheels or rail bogies are provided for transporting and elevating the frame with at least one crawler track or two wheels or rail bogies on a reference side of the mobile machine and at least one crawler track or two wheels or rail bogies on cross slope side of the mobile machine. At least four jacking points having variable vertical extension are placed between the crawler tracks, wheels or rail bogies and frame with two jacking points being on the reference side of the mobile machine and two jacking points being on the cross slope side of the mobile machine. The reference side of the mobile machine tracks a reference in elevation and adapts a desired reference attitude. An attitude sensor on the reference side of the mobile machine measures the actual attitude of the reference side relative to gravity. Likewise, an attitude sensor on the cross slope side of the mobile measures the actual attitude of the cross slope side relative to gravity. The relative elevation between the two jacking points on the cross slope side of the mobile machine is varied to cause the attitude of the cross slope side of the mobile machine to match the attitude of the reference side of the mobile machine. Finally, a single cross slope sensor varies the elevation of the cross slope side of the mobile machine relative to the reference side of the mobile machine.

8 Claims, 6 Drawing Sheets

CROSS-SLOPE LEVEL CONTROL FOR MOBILE MACHINERY

This invention relates to the cross slope control and torsion limitation of large mobile machinery such as road pavers, canal trimmers and liners, conveyors, support frames and like machines. For the purposes this application, the system feature of cross slope control and torsion limitation control shall be simply referenced to as "cross slope control". Each of these features is realized independently of the other. In the present disclosure a single cross slope control is utilized with attitude or pitch on the reference side being measured, relayed and compared to the attitude or pitch being measured on the cross slope side. There results an improved system of cross slope control resulting in superior accuracy of a paving or grading profile when only a single grade reference is used. This cross slope system can be finely adjusted for operational variations. Moreover, this cross slope system seconds as a valuable tool to prevent unwanted torsion of structural frame sections when the large mobile machinery is traveling over uneven ground.

BACKGROUND OF THE INVENTION

Cross slope control for large mobile machines such as canal trimmers and liners and road pavers, although it is not absolutely necessary, offers solutions to age old construction problems if the cross slope control can be done accurately and effectively. To understand the problems that these cross slope controls solve, some attention must be devoted to the construction and transport of these machines.

Typically, large mobile machines for either trimming or lining of canals, the paving of roads, mobile conveyor or support frames have a large supporting steel frame(s) or structures. The large supporting steel frame is supported by conveyance equipment such as crawler tracks or wheels. Suspended from the steel frame is either paving, fine grading, trimming, conveying or lifting equipment. For example, in the preferred embodiments illustrated herein, four crawler tracks are utilized. In all cases, the frame includes four jacking columns—one for varying the elevation of each corner of a machine.

The elevation of the crawler tracks with respect to the large steel supporting frame is individually variable with hydraulically powered jacking columns. Specifically, by individually adjusting the elevation of the large supporting steel frame with respect to each of the crawler tracks, the elevation of the underlying trimming, or pavement can be controlled. In the case of strictly torsion control, each end of the steel frame can be held at the same attitude (relative to each other) preventing damage to the frame from unwanted torsion. In the case of the four crawler track machine, one support point is vertically adjusted from each crawler track. In the case of the two track machine, one support point in front and one support point at the rear of each supporting side bolster are vertically adjusted independently in relationship to a single crawler track.

In all cases except for torsion control, the machine requires a specified path (line) of travel and a reference to grade. These references are normally provided by one or more guide wires; however, line reference is sometimes provided off the edge of a previously poured slab and grade is sometimes referenced off the surface of an accurately placed, previously poured slab or trimmed sub-grade. These guide wires are accurately surveyed into place along the specified path of travel at an elevation that can be used as a reference to grade.

In many applications, guide wires are placed on both sides of the machine. The placement and maintenance of the guide wires can be expensive and, in some cases where space is limited, can cause an obstruction or interference. For example, placing guide wires on both sides of a road is roughly twice as expensive as placing such wires on one side of a road. Further, wires on both sides of a road can interfere with the required paving; trucks transporting concrete to the paving site can be severely restricted in entrance to and exit from a paving site bounded on both sides with guide wires, which causes delay. The wires on both sides can also severely limit the delivery of material to or removal of material from the machine. Also in some cases, there is simply not enough room on one side of the machine to place a guide wire and also have the necessary room for the machine crawler tracks to pass in the path provided.

Recognizing this, the prior art has developed systems for using one wire on one side of the road or pavement and utilizing cross-slope controls. The use of such cross-slope controls can best be understood with respect to a section of roadway having super elevation or banking on a curved section of the road.

It is well known that if a road has a slope extending angularly upward toward the outside of a curve, the slope of the pavement counteracts the centrifugal acting on a vehicle traveling over the curve in the road. The amount of the slope utilized is a function of the radius of curvature of a curve and the designed speed of the road. This slope is commonly referred to as "super elevation."

Assuming that only one guide wire is utilized, the large mobile paving or grading machine must reference its alignment (line) from that one wire and reference any cross-slope from the same single wire. In the prior art, these cross slope controls have included so-called "torsion bar controls" and "multiple cross slope controls."

In what follows, we present a detailed analysis of the weaknesses of the prior art. We are unaware of these weaknesses being cogently set forth and discussed. Accordingly, and in so far as recognition of the problems to be solved constitutes invention, we claim invention in the recognition of these problems as well as their solution:

Torsion bar controls utilize only one of the two transverse beams for the required cross slope control. This transverse beam is provided with a slope sensor that detects the angle of the transverse beam with respect to gravity. By adjusting the elevation of the cross slope side of the machine relative to the reference side of the machine, the slope is changed on the transverse beam to match the desired cross slope. Such a cross slope sensor may be found in the SF-350 Two Track Slipform Paver manufactured by the CMI Corporation of Oklahoma City, Okla., USA.

In addition to the required sensing of the cross slope, it is also required that the attitude or pitch on the reference side of the machine be relayed to the cross slope side of the machine. This is accomplished by CMI's "torsion bar" control. Specifically, a torsion bar is fastened rigidly to the reference side of the machine by means of an actuating arm (lever). This torsion bar extends from the reference side of the machine to the cross slope side of the machine. This extension of the torsion bar occurs through supporting bearings to the cross slope side of the machine. At the cross slope end of the torsion bar, an actuating arm extends from the torsion bar and is connected with a threaded adjusting link to an elevation control sensor to control the elevation of the front jacking column of the cross slope side of the machine. Attitude or pitch changes in the reference side of the machine cause the torsion bar controlled lever arm to vary the attitude or pitch of the cross slope side of the machine. Any adjustment of the attitude differential between the reference side of the machine and the cross slope side of the machine must be accomplished by manually adjusting the threaded adjusting link.

This control produces less than completely satisfactory results. First, for the torsion bar to function with absolute accuracy, it must be assumed that the large supporting steel frame is essentially rigid. This assumption is incorrect. For example, modern paving machines weigh in the range of 100,000 pounds. Even under static conditions, the large steel supporting frame of beam type construction will deflect under load. Moreover, where each of the crawlers encounters changes in elevation, the large steel supporting frames bend and deflect. As the large steel supporting frames bend, the reference that the torsion bars require to maintain the cross slope side level becomes distorted. Thus, because deflection/bending increases as the frame span increases, one can reason that the wider the paving width, the more distorted or inaccurate the cross slope becomes. Variation from the desired level condition of the paving or fine grading results.

Secondly, the crawler tracks propelling such machines often come out of synchronization. For example, the reference side of the machine can be in advance of the cross slope side of the machine while the machine is walking ahead or paving. As a result, the large steel supporting frames often "parallelogram" or change their shape when viewed in plan. When this occurs, the torsion bar is subjected to distortion. Thus, both the large steel supporting frame from which reference must be taken and the torsion bar itself are subjected to distortion and resulting inaccuracy.

Thirdly, there is the distortion and resulting inaccuracies related to the construction of the torsion bar itself. Because of the variable widths that the large supporting steel structure of the machine must assume, the torsion bar must have splices or joints in it so it can be adjusted in length. If these joints are not tight or the torsion bar is not of sufficient section, backlash can occur. In other words, a torsional (angular) movement on the reference side of the machine does not accurately translate into the same angular movement on the cross slope side of the machine.

Finally, even though the primary purpose of the torsion bar system is to keep both sides of the machine parallel with each other, "exact parallelism" is not always desirable. For instance when a highway is approaching a banked curve, one side of the machine may remain at a constant elevation and attitude on the inside of the curve while the other side of the machine must travel on an inclined path while it approaches the high, outside of the banked curve. Since the pavement surface is actually "warped" through this transition from a straight-away to a banked curve, it follows that the paving machine must also be slightly warped (within the limits of its flexibility) to produce a smooth, uniform paved surface. With the torsion bar system it is not feasible to make required differential attitude adjustments to control the warp of the machine frame while operating the paver; thereby, the resulting smoothness quality of the paved surface is adversely affected.

The "multiple cross slope control" is an alternative scheme of cross slope control. In such a control system, the reference side of the machine is provided with two separate transverse beams extending across the machine to the cross slope side of the machine. Typically, one transverse beam is at the front of the machine and the remaining transverse beam is at the rear of the machine. Cross slope sensors for detecting the slope of each of the two transverse beams with respect to gravity are provided.

Operation is easy to understand. As the machine tracks the intended course or alignment of the paving or fine grading, the cross slope sensor on each transverse beam measures the cross slope of each transverse beam. An "on board" computer (microprocessor) then compares the preset slope to the measured cross slope positions and thereafter controls the elevation of the respective forward and rear portions of the cross slope side of the machine by means of changes in the crawler track elevation to bring the machine back to the desired cross slope. This system is fully described in Snow U.S. Pat. No. 3,637,026 issued Jan. 25, 1972.

This system has its own difficulties. First, modern fine graders and pavers can be configured in relatively short and/or narrow configurations. These "compact" configurations can subject the supporting frames to high stresses during changes in crawler track elevation. In short, where the front transverse beam requires an elevation substantially different from the rear transverse beam, twisting of the frame with distortion of the resulting reference beams results. And where the frame is short in the direction of travel or narrow across its width, this tendency is aggravated. Moreover, if only a single transverse beam is used, supported on both ends as described above, the multiple cross slope does not work.

Secondly, such multiple cross slope control machines tend to relay changes in elevation in a loop around the machine. Change in elevation is typically sensed first at the leading portion of the machine at one crawler track. This change is relayed across the machine by detecting the slope of the transverse beam and varying the elevation of the front portion of the frame with respect to the crawler tracks. Unfortunately, the large steel supporting frame is of sufficient torsional rigidity to impart some of this correction through the frame to the rear transverse beam and rear cross slope sensor. Thereafter, and depending upon the elevation adjustment of the front portion of the machine, change is detected at the rear crawler track. This change—induced by adjustment to the forward portion of the machine—can be opposite to the correction of the forward portion of the frame. Thus a cycle of adjustment occurs with elevation changes in effect being relayed around the large steel supporting frame of the machine. This cycle of adjustment leads to further inaccuracy of the placed concrete or trimmed grade. Thirdly, large mobile machines including, but not limited to, those for the paving of roads, fine grading, and bulk material handling have a large supporting steel frame or structure. The large supporting steel frame is supported by conveyance equipment such as crawler tracks or wheels. During transport, accurate control of elevation is critically important. By way of example, it is known that these machines with rigid frames can encounter steep changes in elevation due to uneven ground. Where elevation is not precisely controlled, frame bending occurs often accompanied by splitting of welds and bending or buckling of frame members.

As a final note to the background of this invention, the reader should understand that the accurate control of ultimately placed paving material—either in a canal or on a roadway—is of vital importance to the contractor involved. Generally the smoother the surface that is trimmed or placed, the lower the concrete or placed material losses. Zero material losses means that the actually placed section is equal to the theoretical section. Moreover, for obvious reasons, smooth road surfaces are desirable to the motoring public. From an engineering standpoint, smoother roads last longer. For example, in the case of concrete or asphalt roadways, the finished product is measured by an instrument called a "profilograph." The profilograph measures the smoothness of the road surface. Dependent upon the measurements of these devices, incentive bonuses are either paid or not paid to the contractor for concrete placement. These so-called bonuses can be very large; thus, smoothness is critical to the profitability of the contract. Thus, to be able to realize the benefits of a cross slope control system without sacrificing the trimmed or paved surface smoothness quality is economically advantageous.

SUMMARY OF THE INVENTION

A cross slope level control for a large mobile machine attaches to a frame for supporting equipment including but not limited to those used for paving or fine grading a road bed along a specified path (line) of travel during machine travel. The mobile machine has at least two crawler tracks for transporting the frame along the specified path (line) of travel with at least one crawler track on a reference side of the mobile machine and at least one crawler track on cross slope side of the mobile machine. At least four jacking points extend between the crawler tracks and frame and are provided for supporting the frame. Two jacking points, one on each side of the mobile machine, are on the forward portion of the frame. Likewise, two jacking points, one on each side of the mobile machine, are on the rear portion of the frame.

Each jacking point has variable vertical extension between its associated crawler track and frame. The reference side of the mobile machine is provided with two elevation sensors with wands for tracking elevation and attitude of the reference side of the mobile machine.

An attitude sensor provided on the reference side of the mobile machine causes the actual attitude of the reference side to be sensed relative to gravity. Likewise, an attitude sensor on the cross slope side of the mobile machine causes the actual attitude of the cross slope side to also be sensed relative to gravity. The attitude of the cross slope side is varied to null any sensed attitude difference between the two jacking points on the cross slope side of the mobile machine. This causes the attitude of the cross slope side of the mobile machine to match the attitude of the reference side of the mobile machine. Finally, a single cross slope sensor varies the elevation of the cross slope side of the mobile machine relative to the reference side of the mobile machine to maintain a required cross slope angle.

Provision is made to vary the relative angular relationship between the reference side and cross slope side of the machine. Specifically, and where super elevated highway curves are required, controlled variation of machine attitude between the reference side and the cross slope side can give superior paving and trimming results. Moreover, in the disclosed leveling apparatus, the cross slope can be varied automatically as a function of machine forward travel to produce precise changes of slope through the "transition distances" required to enter into or depart from curves. With the help of the machine's on-board computer and distance measuring wheel with pulse generator mounted off the machine's frame, relative distance traveled by the machine can be accurately monitored by the on-board computer. The machine operator simply enters the transition distance and the cross slope change over the transition distance.

DESCRIPTION OF THE PREFERRED EMBODIMENT

Figure 1:
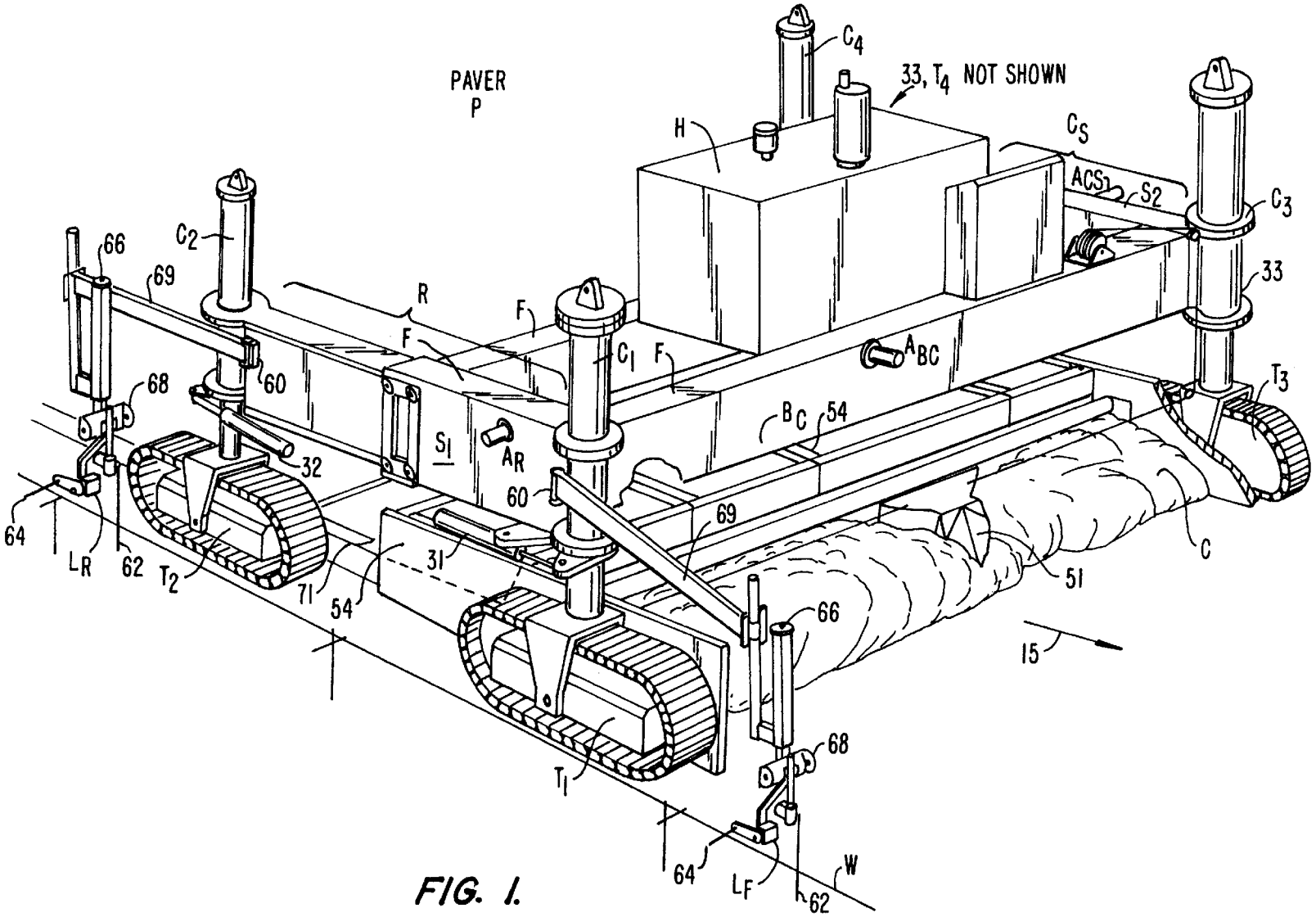
FIG. 1 is an operational schematic of a four track paver having four supporting jacking points illustrating the machine paving with the reference side of the machine sensing a single surveyed wire for elevation and steering reference, and with the elevation and attitude of the cross slope side of the machine being automatically controlled by the cross slope control system.

Referring to FIG. 1, paver P is illustrated. Paver P is shown in an expanded, paving disposition supported by four crawler tracks $T_1$–$T_4$. Paver P includes telescoping side bolsters $S_1$–$S_2$ as set forth in Guntert et al U.S. Pat. No. 5,590,977 issued Jan. 7, 1997 entitled *Four Track Paving Machine and Process of Transport*. When transport is desired, the four track paver P telescopes at telescoping side bolsters $S_1$–$S_2$ to reduce the dimension of the machine in the direction of paving machine travel. When paving is desired, the four track paver P normally telescopes at telescoping side bolsters $S_1$–$S_2$ to expand the dimension of the paving machine in the direction of paving machine travel although in some cases it may be desirable to pave with these side bolsters in their retracted position. The fact that these bolsters are telescoping made the use of the prior art dual cross slope control impractical in that a transverse beam between the rear jacking columns on which a cross slope sensor could be mounted does not exist. A brief review of the apparatus of that disclosure is made here with the understanding that the entirety of the disclosure therein set forth is incorporated herein by reference.

Referring again to FIG. 1, it will be seen that rectilinear tractor frame F is provided. Frame F includes four crawler tracks $T_1$–$T_4$, one at each corner of frame F. Each of the four crawler tracks $T_1$–$T_4$ are directly supported on respective jacking columns containing hydraulic cylinders $C_1$–$C_4$. Jacking Columns $C_1$–$C_4$ are mounted for pivotal movement about the axis of the hydraulic cylinders. Moreover, each jacking column can independently raise and lower frame F from its point of attachment.

Other conventional paver attachments can be identified in FIG. 1. For example, spreader 51 acts to spread concrete C in the path of slipform pan 54. Additionally, and as will be illustrated with respect to wire W, it is necessary that four crawler tracks $T_1$–$T_4$ adjust rectilinear tractor frame F in elevation and in the transport direction. This will be set forth with respect to FIGS. 2A and 2B.

Additionally, this disclosure incorporates the disclosures in U.S. patent applications Ser. Nos. 08/504,858 filed Jul. 20, 1995 and Ser. No. 08/570,760 filed Dec. 12, 1995 both entitled Paving Machine with Extended Telescoping Members, now respectively U.S. Pat. No. 5,615,972 issued Apr. 1, 1997 and U.S. Pat. No. 5,647,688 issued Jul. 15, 1997. A conventional telescoping frame on a paving tractor is provided with fixed male extension members for insertion to and attachment with a telescoping frame member. In the preferred embodiment, telescoping extension occurs across the direction of machine travel.

Referring again to FIG. 1, conventional telescoping frame F includes forward beam $B_F$ and rear beam $B_R$. Forward beam $B_F$ and rear beam $B_R$ define paired forward side by side female tube members 28 and 30 and paired rear side-by-side female tube members 28 and 30. Each forward and rear tube member conventionally acts for the telescoping support of male extension members that attach directly to the cylinder and crawler via a side bolster. Within the limits of expansion, the male extension members, co-acting with clamps acting through the female tube members, provide for both movement of the point of crawler support and expansion of the paving width of the tractor frame. Where extra machine width normal to the direction of travel is required, extenders $E_1$–$E_4$ are added for attachment to the supported end of the male extension members interior of the female telescoping members.

Having described these two related prior art patents, the reader should understand that the preferred embodiment of this invention contemplates paver P utilizing all three of these prior disclosures. It should be further understood that the preferred embodiment of this invention may be used on any two track or four track machine. In the normal case, such respective four crawler tracks $T_1$–$T_4$ include respective steering cylinders 31–34 for causing the crawler tracks to follow grade wire W.

It will be understood that both the path of paver P and the elevation of paver P are established from surveyed guide wire W. Some discussion related to surveyed guide wire W is warranted.

In the paving of roads, it is desired to utilize preferably only one wire to establish both road path and grade elevation of at least one side of the road. Such a surveyed guide wire W is placed at considerable expense. However, path reference is sometimes provided off the edge of a previously poured slab and grade is sometimes referenced off the surface of an accurately placed, previously poured concrete slab or (or subbase) trimmed sub-grade or base. Thus, wherever it is stated herein that an accurately surveyed wire is used to establish both the road path and grade, it is understood that path (or alignment) and grade can be referenced off other accurate references such as previously poured slabs. Where more than one surveyed guide wire W is utilized, this expense multiplies.

Additionally, and where paving is concerned, premiums or bonuses are paid for smooth roads. Specifically, and after a roadway is placed, an instrument known as a profilograph is utilized to measure smoothness. Dependent upon the measured "smooth" condition of the road resulting from the paver's ability to accurately follow both the specified elevations and cross slopes, premiums or bonuses are sometimes paid to the concrete placing contractor. This being the case, this disclosure sets forth a cross slope leveling system having superior accuracy over those known systems previously summarized.

Figure 2A:
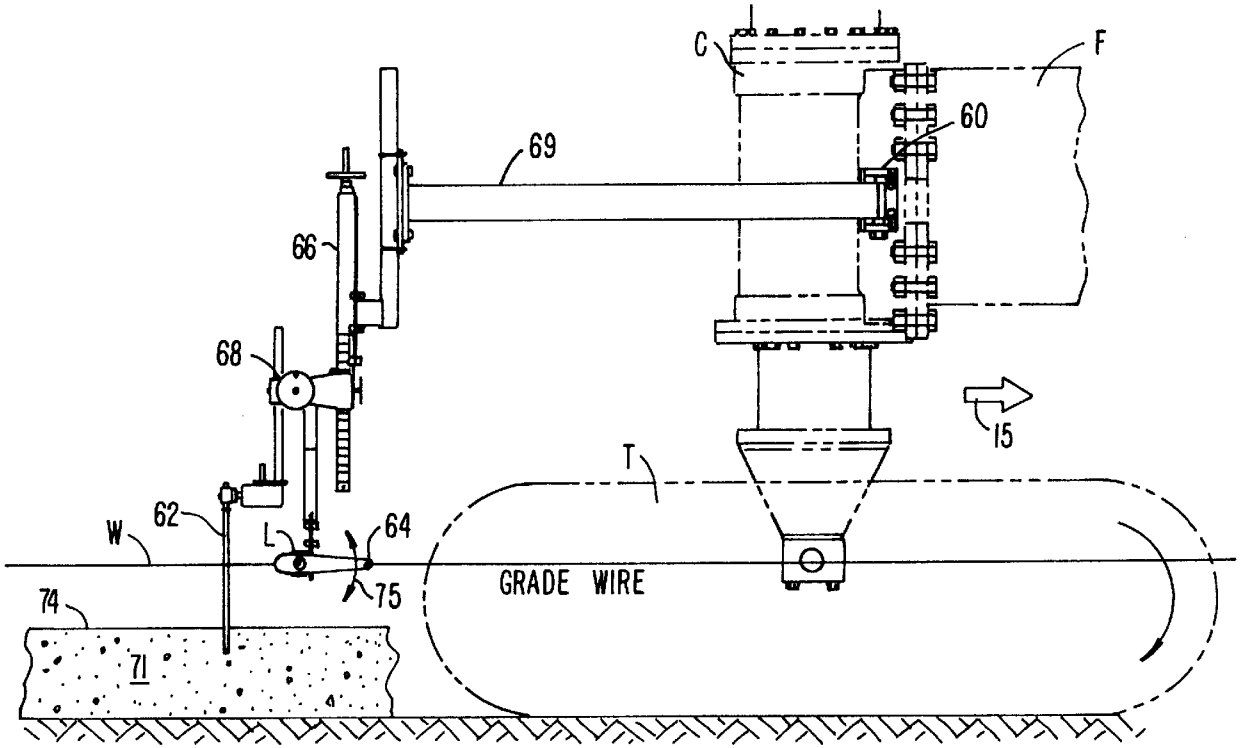
FIGS. 2A and 2B are respective side elevation and plan views of the steering and elevation sensors for controlling one of the four tracks illustrated in FIG. 1.
Figure 2B:
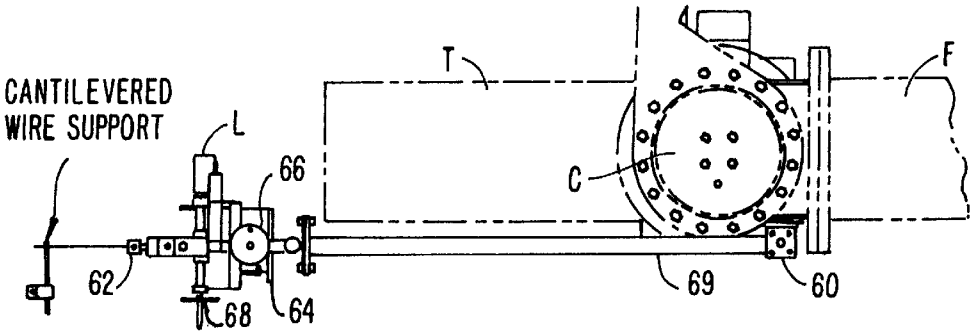

In what follows, we shall first describe with respect to FIGS. 2A and 2B the tracking by paver P of the path of a roadway. Thereafter, the elevation control by paver P at one crawler track T will be set forth. Once that is understood, elevation and attitude control of the so-called reference side of the machine will be set forth. Thereafter, elevation and attitude control of the cross slope side of the machine will be discussed first as to parallelism of the cross-slope side with respect to the reference side and thereafter establishment of the desired cross slope side elevation. Finally, the case of differential attitude adjustment for use between the reference side and the cross slope side of the machine will be discussed.

Referring to FIGS. 2A and 2B, conventional steering and elevation sensors L are illustrated. Bracket 60 is attached at frame F immediately adjacent one crawler track T allowing the sensor support arm 69 to pivot. Steering sensor wand 62 extends vertically and causes the crawler tracks on the respective forward or rear portion of paver P to follow the course of surveyed guide wire W. Likewise, elevation sensor wand 64 follows the elevation of surveyed guide wire W. As is conventional, surveyed guide wire W is cantilevered in its support so that wands 62, 64 can track surveyed guide wire W. Considerable reference adjustment is provided so that paver P travel can be varied within limits with respect to the elevation of surveyed guide wire W. For example, elevation of elevation sensor wand 64 can occur from elevation crank 66. Similarly, towards and away movement of steering sensor wand 62 can be adjusted at side crank 68. Additionally, support arm 69 can be varied—all to assure that frame F at crawler track T nearest to the point of attachment of conventional path and elevation sensors L follows the desired course and jacks frame F to the correct reference elevation.

Turning to FIG. 2A, local elevation 74 of top of slab 71 is referenced from surveyed guide wire W. It will be understood that in the example of FIG. 2A, this elevation is for one corner of rectilinear tractor frame F. Specifically, as crawler track $T_1$ moves forward, elevation sensor wand 64 tracks surveyed guide wire W from underneath (or in some cases on top of the wire). Assuming that local elevation of surveyed guide wire W is parallel with the surveyed grade and the track path varies, elevation sensor wand 64 will move in arc 75. Through apparatus well understood in the prior art, jacking column $C_1$ will vary elevation of frame F responsive to movement of elevation sensor wand 64 in arc 75. This variation will continue until elevation sensor wand 64 returns to the preset or null position shown in FIG. 2A bringing the machine back to its preset and fixed position relative to the reference grade wire.

Returning to FIG. 1, it will be seen that conventional steering and elevation sensors L are placed adjacent each to crawler track $T_1$ and $T_2$. FIG. 1A is illustrated with steering and elevation sensor L for crawler track $T_2$ trailing paver P; FIG. 1A is illustrated with steering and elevation sensor L for crawler track $T_1$ leading paver P, although the placement of the sensors relative to the track may vary.

It will be further understood that in the preferred case, steering and elevation sensors L can be placed on either side of paver P. This placement is merely a function of the side of the pavement path on which surveyed guide wire W is placed when cross slope control is used.

Thus far, the description of the apparatus and leveling process of this invention has been conventional. What follows is the novel portion of this disclosure.

In order to understand the control scheme of this invention, it is necessary to refer back to FIG. 1 and to designate parts of rectilinear frame F with respect to surveyed guide wire W. Specifically, the side of rectilinear frame F adjacent surveyed guide wire W will be referred to as reference side R. The side of rectilinear frame F remote and parallel to surveyed guide wire W will be referred to as cross slope side $C_S$. The leading beam extending across and between reference side R and cross slope side $C_S$ will be referred to as cross slope beam $B_C$. The trailing beam could also be used as the cross slope beam in lieu of the leading beam.

Each of these respective sides of paver P is provided with its own independent attitude sensor. Accordingly, reference side R has reference side attitude sensor $A_R$. Likewise, cross slope side $C_S$ has cross slope side attitude sensor $A_{CS}$. Finally, transverse beam $B_C$ has cross slope sensor $A_{BC}$.

It will be understood that these designations are only relative to surveyed guide wire W. When surveyed guide wire W shifts to the opposite side of paver P, the side and sensor designations likewise change. Thus, it will be understood that once the function of paver P is explained with surveyed guide wire W on one side of the paver, the function of the machine with surveyed guide wire W on the opposite side of paver P immediately follows.

In order to simplify the understanding of this invention, the operation of the leveling system will be discussed in segments. Specifically, the attitude of the reference side will be set forth with respect to FIG. 4A, the repeated attitude set forth with respect to FIG. 4B, the cross slope set forth with respect to FIG. 4C, and finally the variation of the cross slope for entering and leaving super elevated sections of pavement with respect to FIG. 4D. Thereafter, and with reference to FIG. 3, the required reversibility of the schematics of FIGS. 4A–4C will be set forth.

Figure 4A:
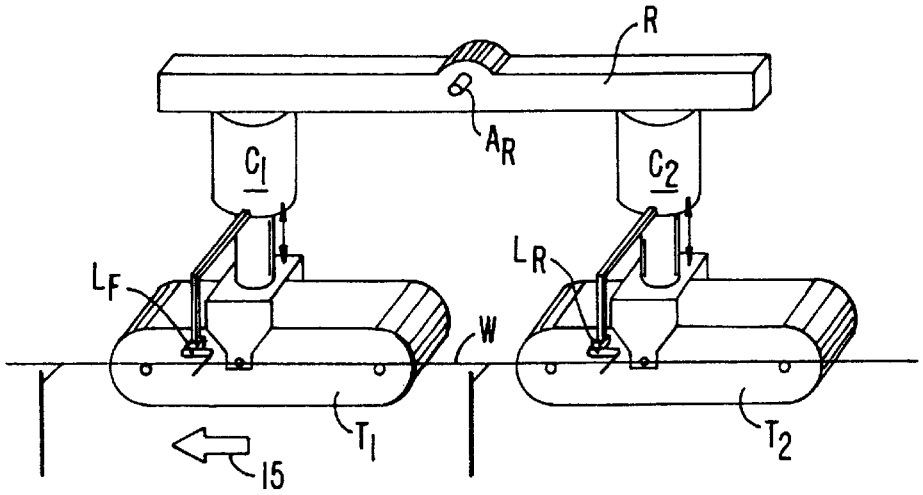
FIG. 4A is a schematic illustrating elevation and attitude control of the reference side of the paver.

Referring to FIG. 4A, the functionality of the preferred embodiment is easy to understand. First, forward conventional elevation sensors $L_F$ and rear conventional elevation sensors $L_R$ completely control the attitude or pitch of reference side R. As surveyed guide wire W varies in elevation and attitude, jacking columns $C_1$ and $C_2$ vary the elevation and attitude of reference side R to maintain it in a present plane. Thus, forward conventional elevation sensors $L_F$ control the elevation of the front portion of reference side R through operation of cylinder $C_1$. Rear conventional elevation sensors $L_R$ control the elevation of the rear portion of reference side R through operation of jacking column $C_2$.

The result is twofold. First, reference side R adapts the attitude or pitch of surveyed guide wire W. This attitude or pitch is measured at reference attitude sensor $A_R$.

Second, and dependent upon the desired elevation of local elevation 74 of top of slab 71 relative to the wire, slipform pan 54 is supported from rectilinear frame F to place the slab at the preset and correct elevation with respect to the wire.

Figure 4B:
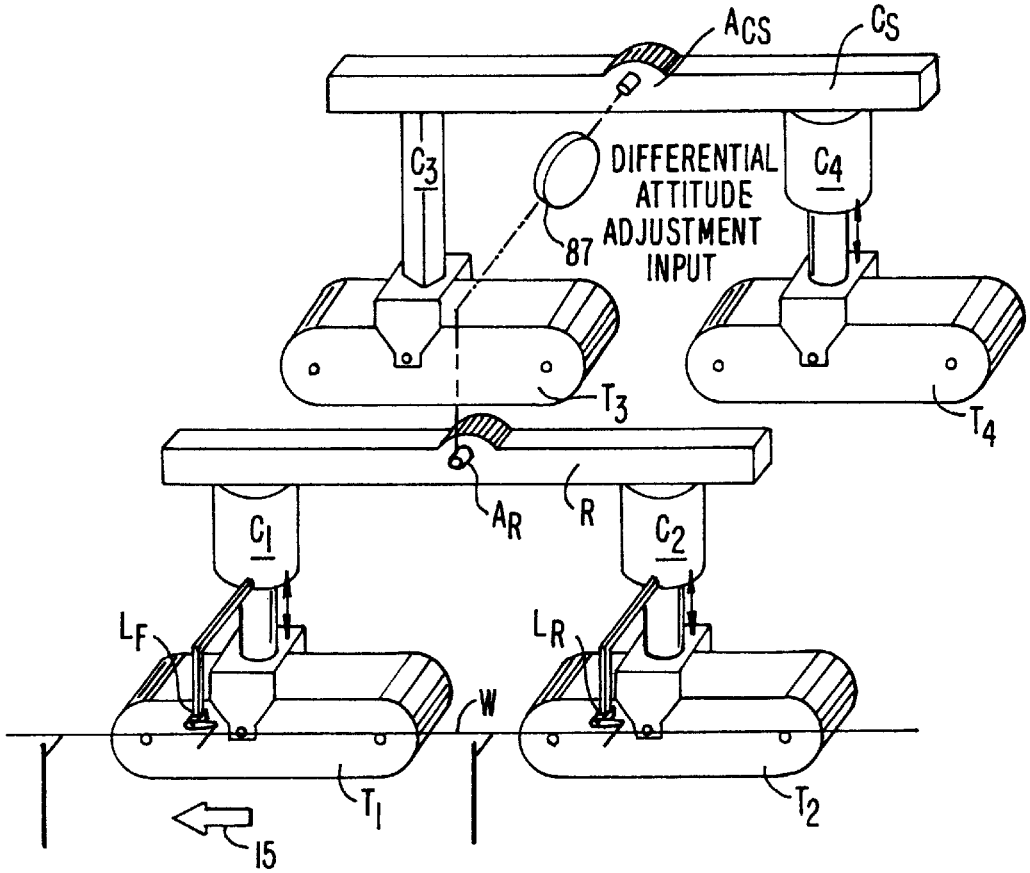
FIG. 4B is a schematic illustrating elevation and attitude control of the cross slope side of the paver.

Referring to the schematic of FIG. 4B, cross slope side $C_S$ through attached attitude sensor $A_{CS}$ repeats the attitude of reference side R. Specifically, rear right jacking column $C_4$ varies the attitude or pitch of cross slope side $C_S$ by raising or lowering rectilinear frame F until attitude sensor $A_{CS}$ matches the gravitationally sensed attitude or pitch of reference attitude sensor $A_R$ as measured on reference side R. Thus, it will be understood that cross slope side $C_S$ is maintained parallel to reference side R.

It will be noted that in FIG. 4B, jacking column $C_3'$ is shown schematically as a solid bar. In the preferred embodiment illustrated herein, only jacking column $C_4$ is active in maintaining the pitch or attitude of cross slope side $C_S$.

It is useful to consider the case where crawler track $T_3$ encounters a change in elevation as it travels in travel direction 15. It will be understood that attitude sensor $A_{CS}$ will, at that instance, no longer match reference attitude sensor $A_R$. Thus, jacking column $C_4$ will immediately respond to adjust the attitude or pitch of cross slope side $C_S$.

Figure 4C:
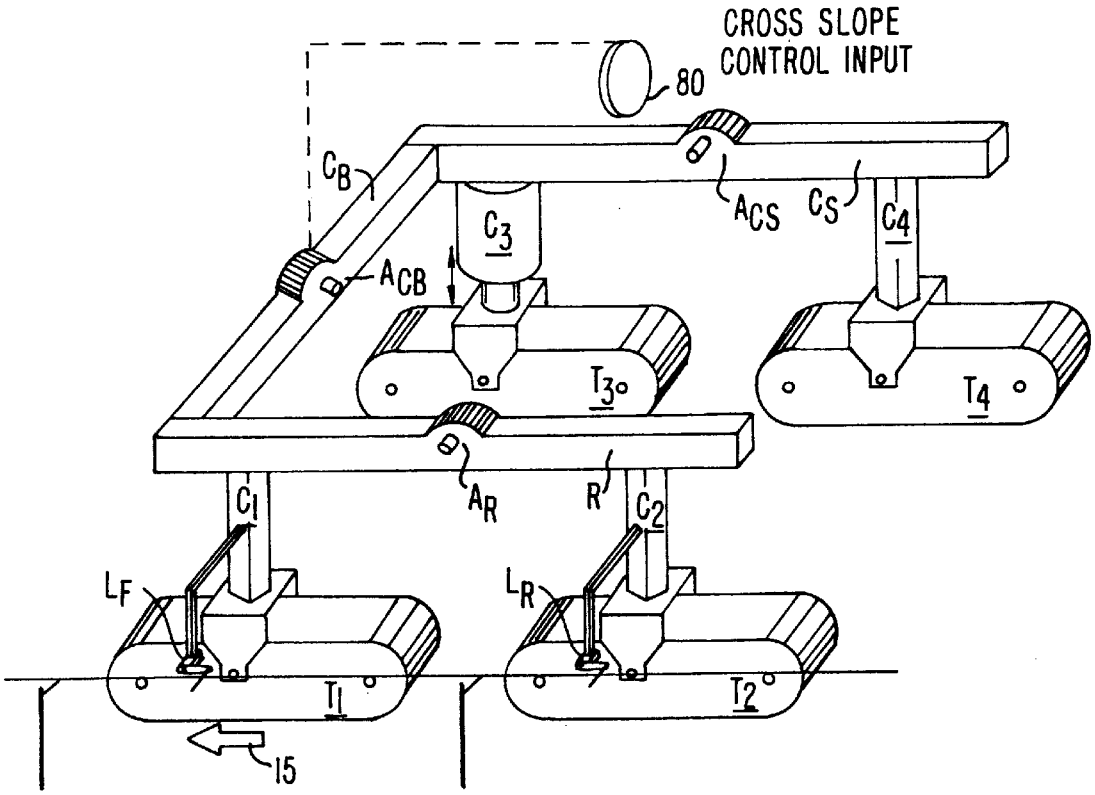
FIG. 4C is a schematic illustrating control of the cross slope disposition of the paver.

Finally, and with respect to FIG. 4C, it will be understood that the desired value for the elevation of cross slope side $C_S$ relative to reference side R is determined by cross beam slope sensor $A_{CB}$ attached to cross beam $C_B$. This cross beam slope sensor $A_{CB}$ varies only the elevation of cylinder $C_3$. Specifically, the desired cross slope will be set by the machine operator at machine operator control console which includes cross slope control adjustment 80. Thereafter, jacking column $C_3$ will vary in elevation until cross beam $C_B$ is in the desired cross slope. In this example, jacking columns $C_1'$, $C_2'$, and $C_4'$ are all shown by bars—indicating that for purposes of this particular cross slope adjustment, they do not respond.

Having set the variable parameters of the conventional path and elevation sensors L and the particular respective jacking columns $C_1$–$C_4$, that they control, the function of the entire paver P can now be discussed.

First, it will be immediately realized that all of the various controls illustrated in FIGS. 4A–4C are interactive. For example, when the elevation of cross slope side $C_S$ changes at cylinder $C_3$, the pitch of cross slope side $C_S$ changes through variation of elevation of frame F relative to jacking column $C_3$. Likewise, when crawler track $T_3$ changes in elevation relative to the ground over which the crawler track travels, jacking column $C_3$ will vary in extension to realize the cross slope and jacking column $C_4$ will vary in elevation to maintain the pitch of cross slope side $C_S$. This will occur in "real time."

It will be understood that paver P requires that surveyed guide wire W change from side to side of the paver. In this instance, conventional steering and elevation sensors L are either relocated or alternatively provided with duplicate sensors on the opposite side the machine. Further, it will be understood that the operation of the machine will be the same as that previously illustrated with respect to FIGS. 4A–4C, only the respective sides of paver P from which actuation occurs will be switched.

Figure 3:
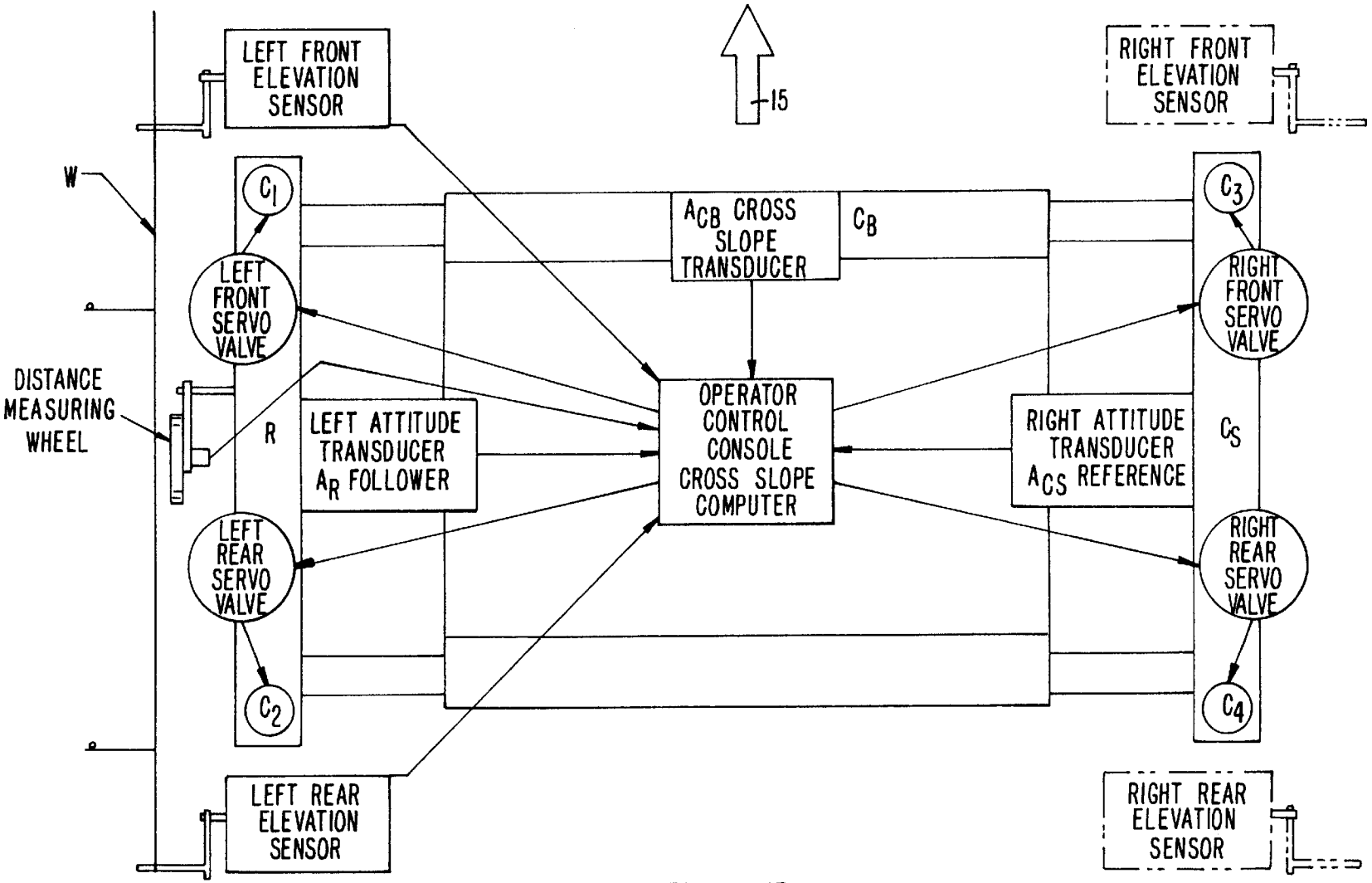
FIG. 3 is a schematic illustrating the required switching of the controls where the surveyed wire changes side relative to the path of the paver.

Referring to FIG. 3, such an overall control is schematically illustrated. Specifically, control console 85 is illustrated with schematic arrows indicating the control routing for the shifting of surveyed guide wire W from one side of paver P to the opposite side of paver P.

During the paving of the superelevated (as in banked curves) sections of roadway, it is frequently required that the elevated side of the machine had a slightly altered attitude relative to the lower side of the machine. For example, during paving, vibrators are utilized to temporarily "liquefy" the concrete being placed. This concrete, in the liquefied state, tries to flow from the elevated portion of the pavement to the lower portion of the pavement due to the effects of gravity. To counteract this tendency, the attitude or pitch of the elevated side of the machine should be optimally and incrementally increased. This traps a greater quantity of concrete on the elevated side and exerts a higher finishing pressure on the concrete at the rear of the slipform pan on the elevated side. In torsion bar type machines, this type of adjustment is difficult, if not impossible to produce while the machine is moving. Additionally when a highway transitions from a straight section into a banked curve, one side of the machine may remain at a constant elevation and attitude throughout the inside run of the curve while the other side of the machine must travel on an inclined path as it approaches the elevated, outside of the banked curve. Since the pavement surface is actually "warped" through this transition from a straightaway to a banked curve, it has been proven that the paving machine must also be slightly warped (within the limits of its flexibility) to produce a smooth, uniform paved surface. With the torsion bar system it is not feasible to make the required incremental differential attitude adjustments to slightly and accurately warp the frame while operating the paver so the resulting quality of the paved surface is adversely affected.

Referring to FIG. 4B, differential attitude control 87 is shown. Where differential attitude is required, the operator inputs the desired differential angle into differential attitude control at the operator console and cross slope side $C_S$ attitude varies relative to reference side R to maintain desired attitude differential.

Finally, and referring to FIG. 4C, when cross slope must be varied, as when approaching super elevated curves, change in cross slope is preferably made gradually and incrementally with respect to the direction of machine travel. Specifically, it is desired to have a gradual and incremental increase in slope with respect to distance as the curve is approached. Likewise, it is desired to have the slope decrease as the curve is completed. In either case, careful adjustment of the cross slope relative to gravity must occur. Although possible, it is very difficult to achieve these precise adjustments using the manual methods of the prior art.

Figure 4D:
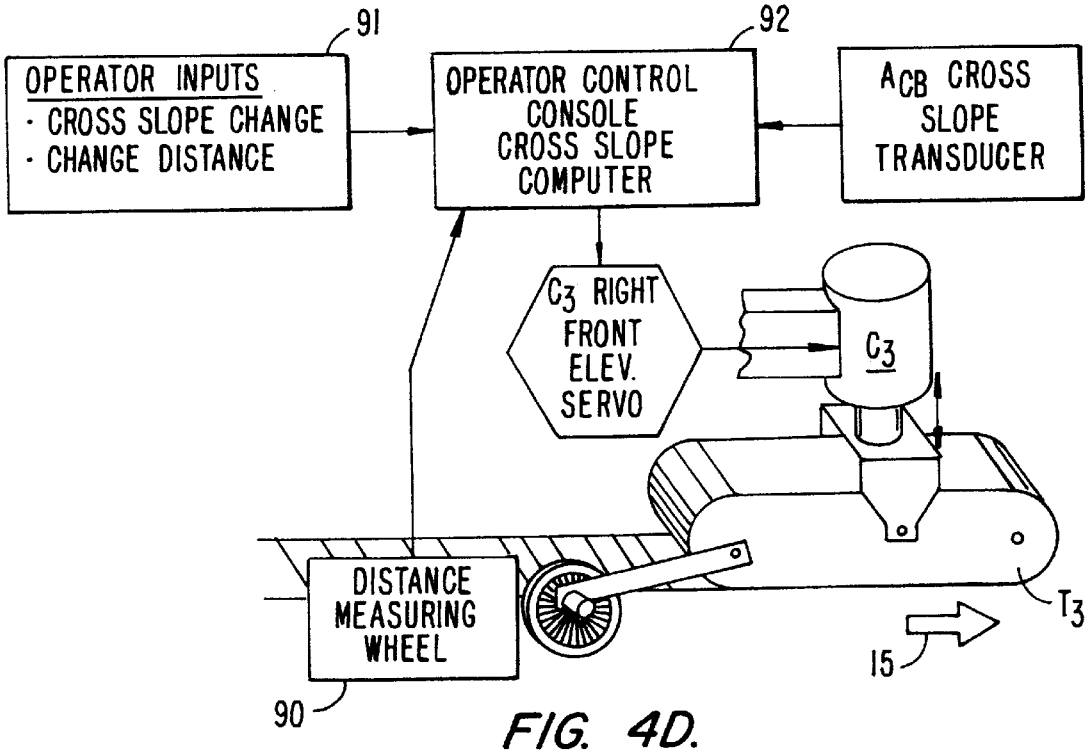
FIG. 4D is a schematic illustrating the capability of the leveling control to gradually vary super elevation of a roadway; and, FIG. 4E is a schematic illustrating the leveling control of this invention adapted to apparatus utilizing rail and wheel transport.

Referring to FIG. 4D, apparatus for causing this gradual and incremental cross slope change to occur is schematically illustrated. Specifically, distance traveled by crawler track $T_3$ is measured and input to the cross slope computer odometer by means of a wheel mounted pulse generator or distance counter 90 attached to the machine and travelling along side the track path. The cross slope or cross slope chance and chance distance 91 over which the change is desired is input to cross slope computer 92 by the machine operator. The actual cross slope that the machine sees is measured by cross slope sensor $A_{BC}$ mounted on machine Cross Slope Beam $B_C$. The cross slope sensor $A_{BC}$ inputs its position in relationship to gravity into the cross slope computer. In turn, the cross slope computer sends an output signal to the servo-valve which actuates cylinder $C_3$ to maintain the operator inputed cross slope or cross slope change at a particular point on the cross slope side of the machine in reference to the reference side of the machine. All these inputs and outputs are processed by the cross slope computer with the result being that cross slope of the machine gradually and predictably changes in very small increments during forward machine travel.

Figure 4E:
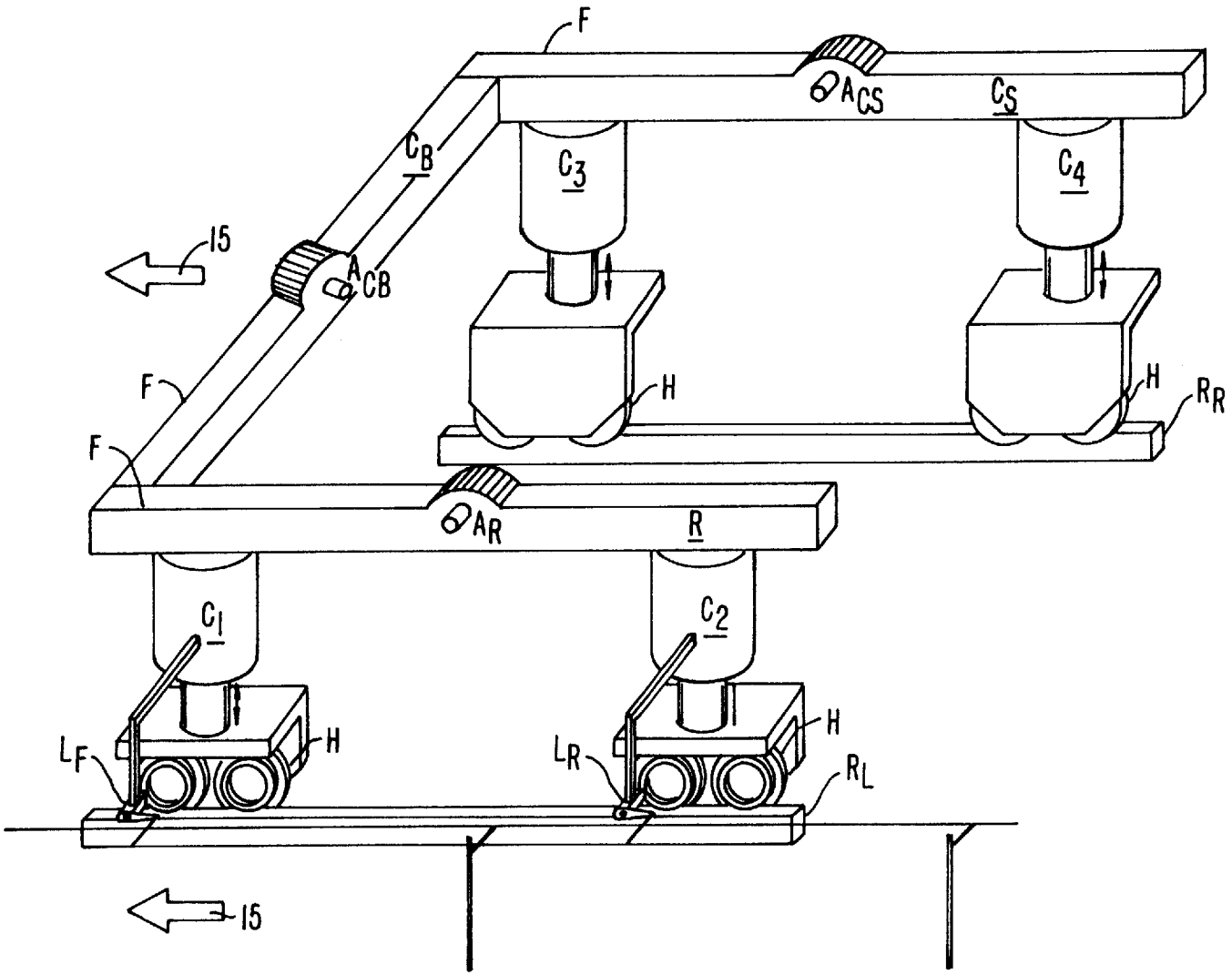

Thus far we have shown this cross slope level control being utilized with tractor crawler tracks supporting a guide wire directed and stabilized frame. It should be apparent to the reader that the cross slope control of this invention is not so limited. By way of example, and with reference to FIG. 4E, left rail $R_L$ and right rail $R_R$ support rectilinear tractor frame F through respective hydraulic cylinders $C_1$–$C_4$ and underlying rail wheels H. As those having skill in the art will understand, this type of leveling apparatus is common with respect to heavy paving such as that found in some types of canal lining equipment and bridge deck finishing equipment.

Those having skill in the art will realize that changes to the preferred embodiment of control as illustrated herein may be made. For example, the particular jacking column C causing elevation change of rectilinear frame F for either attitude or cross slope can be reversed. Further, this invention will be understood by those having ordinary skill in the art to be equally applicable to so-called two track pavers. These types of pavers only differ from the pavers here illustrated in that two points of frame support are taken from each crawler track instead of one point of support from each crawler track. It is further understood that being able to automatically control the attitude of one end of a machine in relationship to the other even when traveling the machine over uneven terrain has significant benefits. Torsion to the supporting frame or truss can be effectively eliminated preventing undesirable stresses on welds and prevent truss/structural frame members from buckling or bending.

What is claimed is:

1. In a cross slope level/torsion control for mobile machine comprising in combination:

a frame for supporting paving, fine grading, conveying or supporting equipment while traveling along a path under the mobile machine;

at least two crawler tracks for transporting and elevating the frame with at least one crawler track on a reference side of the mobile machine and at least one crawler track on cross slope side of the mobile machine;

at least four jacking points having variable vertical extension are placed between the crawler tracks and frame with two jacking points being on the reference side of the mobile machine and two jacking points being on the cross slope side of the mobile machine;

means on the reference side of the mobile machine for tracking a reference in elevation to determine a desired reference attitude for the reference side of the mobile machine;

means operatively connected to the two jacking points on the reference side of the mobile machine to vary actual attitude of the reference side of the mobile machine to assume the desired reference attitude;

an attitude sensor on the reference side of the mobile machine for causing the actual attitude of the reference side to be sensed relative to gravity;

an attitude sensor on the cross slope side of the mobile machine for causing the actual attitude of the cross slope side to be sensed relative to gravity;

means for varying the relative elevation between the two jacking points on the cross slope side of the mobile machine to cause the attitude sensor of the cross slope side of the mobile machine to null to a predetermined value relative to the reference side of the mobile machine; and, a single cross slope sensor for causing the actual cross slope to be sensed relative to gravity; and, means for varying together the elevation of the cross slope side of the mobile machine relative to the reference side of the mobile machine to produce a desired cross slope.

2. In a cross slope level control for mobile machine according to claim 1 and wherein:

means for varying the relative elevation between the two jacking points on the cross slope side of the mobile machine to cause the attitude sensor of the cross slope side of the mobile machine to be the same as the reference side of the mobile machine.

3. In a cross slope level control for mobile machine according to claim 2 and wherein:

the means for varying the relative elevation between the two jacking points on the cross slope side of the mobile machine includes only varying the elevation of one jacking point on the cross slope side of the machine.

4. In a cross slope level control for mobile machine according to claim 3 and wherein:

the means for varying the relative elevation between the two jacking points on the cross slope side of the mobile machine includes only varying the elevation of a rear jacking point.

5. In a cross slope level control for mobile machine according to claim 1 and wherein:

the means for varying together the elevation of the cross slope side of the mobile machine relative to the reference side of the mobile machine to produce a desired cross slope includes varying the elevation of one cylinder only.

6. In a cross slope level control for mobile machine according to claim 5 and wherein:

the means for varying together the elevation of the cross slope side of the mobile machine relative to the reference side of the mobile machine to produce a desired cross slope includes varying the elevation of leading cylinder only.

7. In a cross slope level/torsion control for mobile machine comprising in combination:

a frame for supporting paving, fine grading, conveying or supporting equipment while traveling along a path under the mobile machine;

at least two crawler tracks for transporting and elevating the frame with at least one crawler track on a reference side of the mobile machine and at least one crawler track on cross slope side of the mobile machine;

at least four jacking points having variable vertical extension are placed between the crawler tracks and frame with two jacking points being on the reference side of the mobile machine and two jacking points being on the cross slope side of the mobile machine;

an attitude sensor on the reference side of the mobile machine for causing the actual attitude of the reference side to be sensed relative to gravity;

an attitude sensor on the cross slope side of the mobile machine for causing the actual attitude of the cross slope side to be sensed relative to gravity;

means for varying the relative elevation between the two jacking points on the cross slope side of the mobile machine to cause the attitude sensor of the cross slope side of the mobile machine to null to a predetermined value relative to the reference side of the mobile machine; and, a single cross slope sensor for causing the actual cross slope to be sensed relative to gravity; and, means for varying together the elevation of the cross slope side of the mobile machine relative to the reference side of the mobile machine to produce a desired cross slope.

8. In a cross slope level/torsion control for mobile machine according to claim 7 and comprising in further combination:

means on the reference side of the mobile machine for tracking a reference in elevation to determine a desired reference attitude for the reference side of the mobile machine; and, means operatively connected to the two jacking points on the reference side of the mobile machine to vary actual attitude of the reference side of the mobile machine to assume the desired reference attitude.

* * * * *